US006168445B1

(12) United States Patent
Seutschniker et al.

(10) Patent No.: US 6,168,445 B1
(45) Date of Patent: Jan. 2, 2001

(54) TWO-PART ELECTRICAL CONNECTOR

(75) Inventors: Roman Seutschniker; Peter Schekalla, both of Wuppertal (DE)

(73) Assignee: Delphi Technologies, Inc., Troy, MI (US)

( * ) Notice: Under 35 U.S.C. 154(b), the term of this patent shall be extended for 0 days.

(21) Appl. No.: 09/238,538

(22) Filed: Jan. 27, 1999

(30) Foreign Application Priority Data

Feb. 23, 1998 (GB) ..... 9803579

(51) Int. Cl.[7] ..... H01R 13/62
(52) U.S. Cl. ..... 439/157
(58) Field of Search ..... 439/157, 347, 439/345

(56) References Cited

U.S. PATENT DOCUMENTS

| | | | | |
|---|---|---|---|---|
| 5,672,067 | * | 9/1997 | Ryll et al. | 439/157 |
| 5,681,175 | * | 10/1997 | Busse et al. | 439/157 |
| 5,876,226 | * | 3/1999 | Tsukakoshi et al. | 439/157 |
| 5,899,762 | * | 5/1999 | Ainceri | 439/157 |

FOREIGN PATENT DOCUMENTS

| | | |
|---|---|---|
| 0 669 680 A1 | 8/1995 | (EP) . |
| 2300767 | 11/1996 | (GB) . |

* cited by examiner

*Primary Examiner*—Steven L. Stephan
*Assistant Examiner*—Amir Abdulmelik

(74) *Attorney, Agent, or Firm*—Richard A. Jones

(57) ABSTRACT

An electrical connector (10) comprising a first part (12) including a housing (16) having opposed side walls (18,20) each having an upper wall (24) and a lower wall (26) defining opposed slide surfaces (28) extending in a direction substantially perpendicular to a mating axis (X), first and second spaced apertures (34,36) in the upper wall, a pair of spaced apertures (38) in the lower wall, and a longitudinally extending slot (66) in the upper wall; a slider (30,31) positioned adjacent each side wall, each slider having an upper edge (54) and a lower edge (50) making a sliding engagement with the slide surfaces of the upper wall and the lower wall, a pair of inclined cam surfaces (46) having openings (48) in the lower edge alignable with the apertures in the lower wall, and a resilient tab (52) in the upper edge for making a snap fit in the first aperture in the upper wall in a fully unmated position, or in the second aperture in a fully mated position; a substantially U-shaped lever (58) having a pair of arms (60), each arm extending through the slot in the side wall to be positioned between the side wall and the adjacent slider; pivot means (62,68) on each arm and each side wall to allow the lever to pivot relative to the housing of the first part; and drive means (64,70) on each arm and each slider to slide each slider relative to the adjacent side wall on pivoting of the lever relative to the housing; and a second part (14) including a housing (78) having side walls (80) each having a pair of spaced cam followers (84) which can pass through the apertures in the lower walls and the openings in the inclined cam surfaces for sliding movement along the cam surfaces; pivoting movement of the lever moving the second part relative to the first part along the mating axis between the fully unmated position and the fully mated position.

14 Claims, 5 Drawing Sheets

76
58
60
200
18
54
36
56
52
34
12
24
16
94
96
22
46
46
22
62
48
38
50
68
48
38
26

76
58
60
300
18
24
54
30
36
56
52
34
12
16
68'
62'
22
46
46
22
48
38
50
64'
48
38
26
70'

TWO-PART ELECTRICAL CONNECTOR

TECHNICAL FIELD

The present invention relates to a two-part electrical connector in which a lever to used for mating and unmating of the two parts.

BACKGROUND OF THE INVENTION

A two-part electrical connector with a lever for mating and unmating of the two parts is disclosed in EP-A-0722203. The lever is substantially U-shaped and is pivotally mounted on the housing of one part of the connector. A pair of sliders are also mounted on the same housing and slide on pivoting of the lever. The sliders have cam surfaces which engage corresponding cam followers on the housing of the other part of the connector. Pivoting of the lever causes the sliders to slide to mate or unmate the two parts of the connector. The pivot connection between the lever and the housing of the one part of the connector requires an arcuate slot in each arm of the lever.

SUMMARY OF THE INVENTION

The object of the present invention is to provide a two-part electrical connector which is an improvement of the above mentioned arrangement.

An electrical connector in accordance with the present invention comprises a first part mateable with a second part along an axis, the first part including a housing having opposed side walls and opposed end walls, each side wall having an upper wall and a lower wall defining opposed slide surfaces extending in a direction substantially perpendicular to the mating axis, first and second spaced apertures in the upper wall of each side wall, a pair of spaced apertures in the lower wall of each side wall, and a longitudinally extending slot in the upper wall of each side wall; a slider positioned adjacent each side wall, each slider having an upper edge and a lower edge making a sliding engagement with the slide surfaces of the upper wall and the lower wall, respectively, of the side walls, a pair of inclined cam surfaces having openings in the lower edge alignable with the apertures in the lower wall of the side walls, and a resilient tab in the upper edge for making a snap fit in the first aperture or the second aperture in the upper wall of the side wall; a substantially U-shaped lever having a pair of arms, each arm extending through the slot in the side wall to be positioned between the side wall and the adjacent slider; pivot means on each arm and each side wall to allow the lever to pivot relative to the housing of the first part; and drive means on each arm and each slider to slide each slider relative to the adjacent side wall on pivoting of the lever relative to the housing of the first part; the second part including a housing having side walls and end walls positionable inside the side wall and end walls of the housing of the first part, each side wall of the housing of the second part having a pair of spaced cam followers which can pass through the apertures in the lower walls and the openings in the inclined cam surfaces for sliding movement along the cam surfaces; pivoting movement of the lever moving the second part relative to the first part along the mating axis between a fully unmated position in which the tabs on each slider make a snap fit in the first aperture in the upper walls and a fully mated position in which the tabs make a snap fit in the second aperture in the upper walls.

Relative to the above mentioned prior known arrangement, the sliders are protected by the side walls, means are provided for holding the sliders in the fully mated and fully unmated positions, and there is no requirement for an arcuate slot in each arm of the lever.

BRIEF DESCRIPTION OF THE DRAWINGS

The present invention will now be described, by way of example, with reference to the accompanying drawings, in which.

DESCRIPTION OF THE PREFERRED EMBODIMENT

Figure 1:
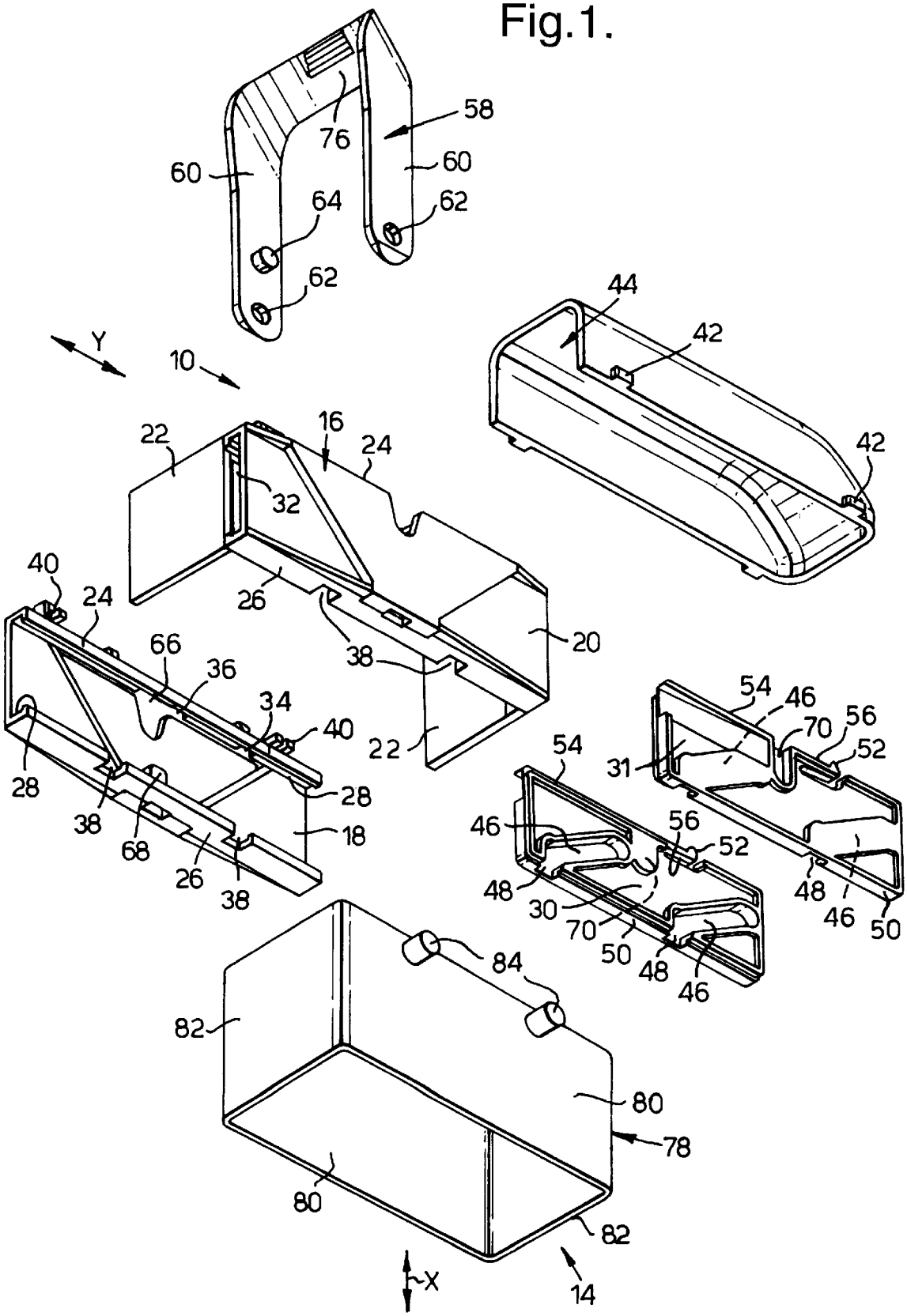
FIG. 1 is an exploded view of a first embodiment of two-part electrical connector in accordance with the present invention.
Figure 2:
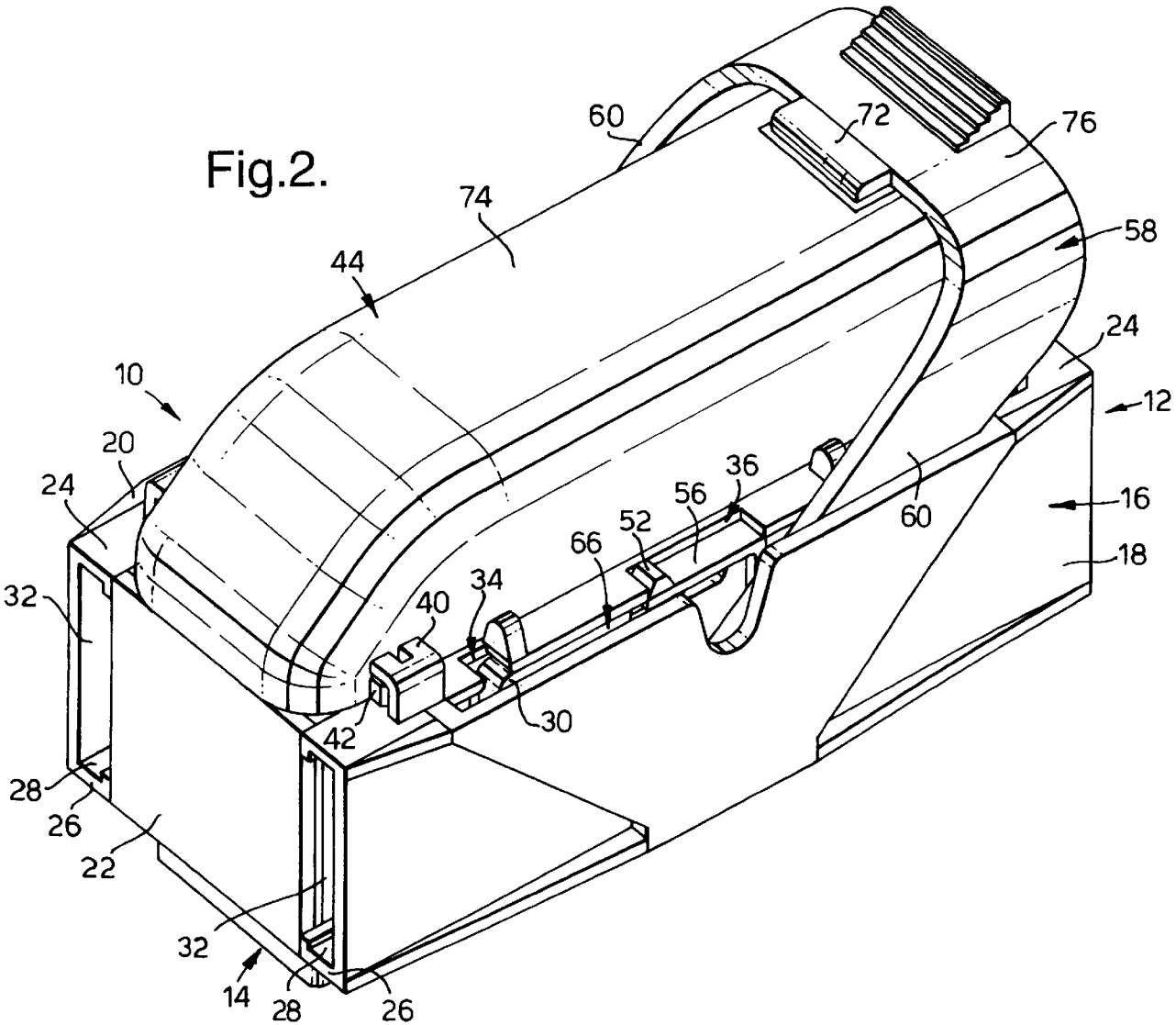
FIG. 2 is a perspective view of the connector of FIG. 1 with the lever in the fully mated position.
Figure 3:
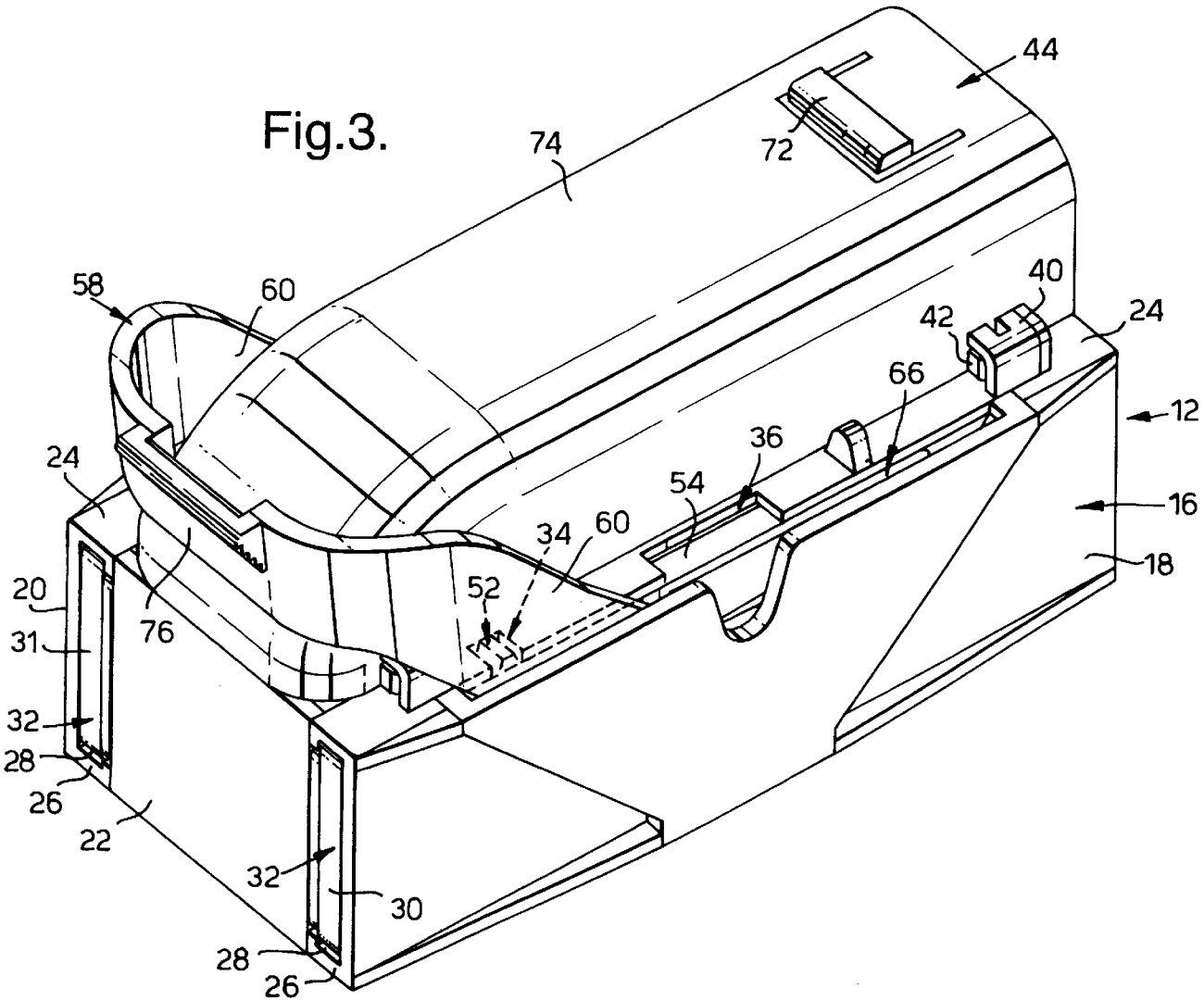
FIG. 3 is a similar view to that of FIG. 2 of the first part of the connector with the lever in the fully unmated position.

Referring to FIGS. 1 to 3, the first embodiment of two-part electrical connector 10 in accordance with the present invention comprises a first part 12 and a second part 14. Each part 12,14 is capable of receiving an retaining electrical contacts or terminals (not shown). On mating of the first and second parts 12,14, the contacts in the first part 12 mate with, and complete an electrical connection with, the corresponding contacts in the second part 14. Any suitable type of contacts may be used. The first part 12 mates (mechanically and electrically connects) or unmates (mechanically and electrically disconnects) with the second part 14 by moving the parts relative to one another in an axial direction X.

The first part 12 of the connector 10 comprises a housing 16 of electrically insulating material, which is preferably plastics material, and which is preferably moulded in one piece. The housing 16 comprises first and second side walls 18,20 and end walls 22. Each side wall 18,20 has an upper wall 24 and a lower wall 26. The upper wall 24 and the lower wall 26 of each side wall 18,20 define, internally of the housing 16, slide surfaces 28 for a slider 30,31, respectively, positioned adjacent the side wall. Each slide surface 28 extends in a direction Y which is substantially perpendicular to the mating axis X. Each slider 30,31 (which is preferably moulded in one piece from plastics material) is inserted into the housing 16 by way of slots 32 formed between the side walls 18,20 and the end walls 22. First and second spaced apertures 34,36 are formed in the upper wall 24 of each side wall 18,20, and a pair of spaced apertures 38 are formed in the lower wall 26 of each side wall 18,20. The upper wall 24 of each side wall 18,20 has latch means 40 on its outer surface which makes a snap fit with corresponding latch means 42 on a cover 44 of the first part 12 of the connector 10.

Each slider 30,31 has a pair of inclined channels 46 formed therein which open at an opening 48 through a lower edge 50 of the slider. The channels 46 are open sided and formed on the internal surface of each slider 30,31. The openings 48 in each slider 30,31 have the same spacing as the apertures 38 in the corresponding side wall 18,20, such that the openings 48 can align with the pair of spaced apertures 38. The channels 46 in each slider 30,31 are inclined in the same direction at the same angle and open inwardly towards the other slider. The channels 48 in each slider 30,31 are inclined in the same direction. A tab 52 is formed in the upper edge 54 of each slider 30,31 either on a resilient arm 56, as shown, or on a resiliently flexible beam (not shown). Each tab 52 is capable of making a snap fit in the first aperture 34 or the second aperture 36 in the upper wall 24 of the corresponding side wall 18,20. The upper edge 54 and the lower edge 50 of each slider 30,31 makes a sliding fit with the slide surface 28 of the upper wall 24 and the lower wall 26 of the corresponding side wall 18,20.

The first part 12 of the connector 10 further comprises a substantially U-shaped lever 58 having a pair of substantially parallel arms 60. Each arm 60 of the lever 58 has an aperture 62 and a pin 64, the apertures being substantially aligned and the pins being substantially alignedso that the aperture 62 alignment is substantially parallel to the pin 64 alignment. Each arm 60 passes through a longitudinally extending slot 66 in the upper wall 24 of each side wall 18,20 and the aperture 62 in each arm makes a snap fit with a corresponding pin 68 formed internally on each side wall 18 and 20. With this arrangement the pins 68 define a pivot axis for the lever 58 to allow the lever to pivot relative to the housing 16. The pivot axis is fixed with respect to the housing. The pin 64 of each arm 60 makes a sliding fit in a channel 70 formed in the corresponding slider 30,31. Each channel 70 extends substantially along the mating axis X, opens through the upper edge 54 of each slider 30,31, and is formed in the opposite side (the external side) of the slider 30,31 to the inclined channels 46. Also formed on the external side of slider 30,31 and substantially perpendicular to channel 70 is ramp 55. Ramp 55 guides pin 64 of lever 58 into channel 70 while slider 30,31 is being staged into housing 16 through slots 32. The slider 30,31 is engaged to the upper wall 24 and lower wall 26. As a pre-staging event, pin 64 is biased against ramp 55 until slider 30,31 is functionally positioned within housing 16, whereupon, pin 64 snaps into channel 70 off of ramp 55. When the first part 12 is fully assembled, the lever 58 holds the first wall 18 to the end walls 22 of housing 16 by biasing the engaged sliders 30,31 toward each other and against the upper and lower wall 24,26.

On assembly, each arm 60 of the lever 58 is therefore positioned between the sliders 30,31 and the adjacent side wall 18,20. With this arrangement, as the lever 58 pivots relative to the housing 16, the pins 64 slide in the channels 70 in the mating direction X relative to the sliders 30,31 such that the lever 58 drives (moves) the sliders in the direction Y relative to the side walls 18,20.

The cover 44 preferably includes a resilient latch tab 72 formed in its upper surface 74 which makes a snap fit with the base portion 76 of the lever 58 when the first and second parts 12,14 are fully mated (as shown in FIG. 2).

The second part 14 of the connector 10 has a housing 78 having side walls 80 and end walls 82. A pair of pins 84 is formed externally on each side wall 80. The pins 84 on each side wall 80 have the same spacing as the apertures 38 in the lower wall 26 of the corresponding side wall 18,20 of the housing 16 of the first part 12. The side walls 80 and end walls 82 of the housing 78 of the second part 14 fit inside the side walls 18,20 and end walls 22 of the housing 16 of the first part 12. During mating and unmating, the pins 84 pass through the apertures 38 and slide along the inclined channels 46 formed in the sliders 30,31 in such a manner that the pins 84 function as cam followers and the channels function as cam surfaces. The apertures 38 in one side wall 18 and the corresponding pins 84 preferably have a different spacing from the apertures 38 in the other side wall 20 and the corresponding pins 84 for correct alignment and mating of the first and second parts 12,14.

Prior to mating, the lever 58 is moved to the position shown in FIG. 3. In this position of the lever 58, the tabs 52 on the sliders 30,31 make a snap fit in the first apertures 34 in the upper walls 24 of the side walls 18,20 to substantially retain the sliders and the lever in this position and ensure alignment of the openings 48 in the inclined channels 46 with the apertures 38 in the lower walls 26 of the side walls. The second part 14 of the connector 10 is then moved into position for mating with the pins 84 on the housing 78 of the second part passing through the apertures 38 in the lower wall 26 of each side wall 18,20 of the housing 16 of the first part 12 and into the inclined channels 46 in the sliders 30,31. To mate the first and second parts 12,14, the lever 58 is pivoted relative to the housing 16 of the first part towards the fully mated position shown in FIG. 2, to release the tabs 52 from the first apertures 34 in the upper walls 24. During this pivoting movement of the lever 58, the pins 84 on the housing 78 of the second part 14 are forced along the inclined channels 46 as the sliders 30,31 slide relative to the side walls 18,20 (along axis Y) of the housing 16 of the first part 12 to move the second part in along mating axis X relative to the first part to mate the first and second parts. When the first and second parts 12,14 become fully mated, the tabs 52 on the sliders 30,31 makes a snap fit in the second apertures 36 in the upper walls 24 of the side walls 18,20 of the housing 16 of the first part 12 to substantially retain the first and second parts in the fully mated position. To further ensure the retention of the fully mated position of the first and second parts 12,14, the lever 58 then makes a snap fit with the tab 72 on the cover 44. To unmate the first and second parts 12,14, the lever 58 is released from the tab 72 and pivoted from the position shown in FIG. 2 to the position shown in FIG. 3 for reverse movement to that described above for mating of the first and second parts.

Figure 4:
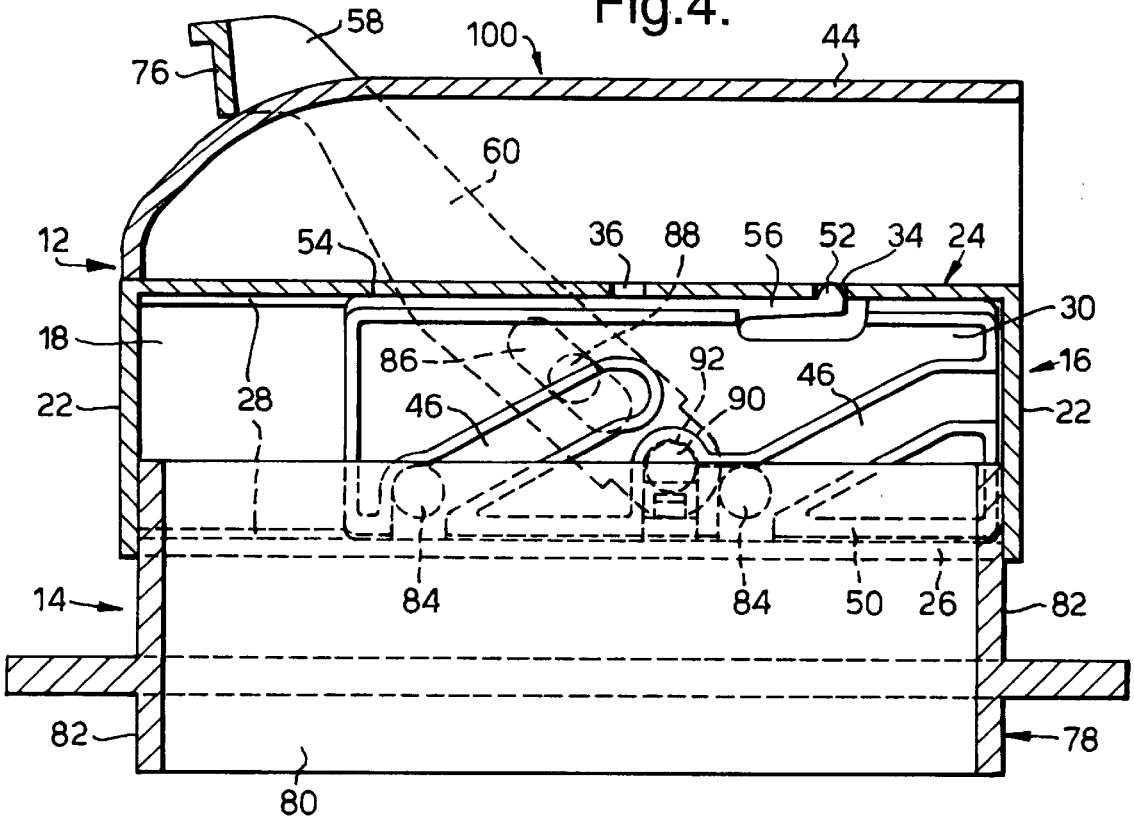
FIG. 4 is a cross-section view of a second embodiment of electrical connector in accordance with the present invention with the lever in the fully unmated position.
Figure 5:
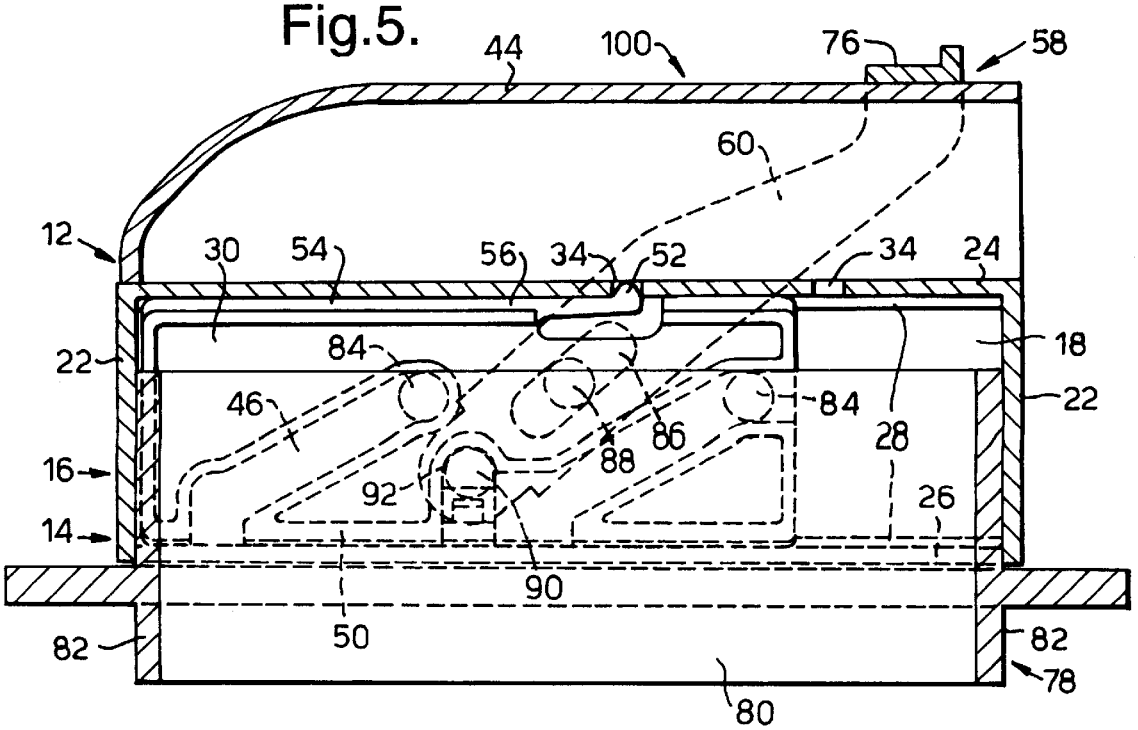
FIG. 5 is a similar view to that of FIG. 4 with the lever in the fully mated position.

The second embodiment of electrical connector 100 shown in FIGS. 4 and 5 is substantially the same as the first embodiment, and like parts have been given the same reference numeral. The second embodiment differs from the first embodiment in respect of the arrangement of the pivot means between the lever 58 and the housing 16 of the first part 12, and the drive means between the lever 58 and the sliders 30,31. In the second embodiment, the pivot means comprises a slot 86 (replacing pin 64) formed in each arm 60 of the lever 58, the slots extending in a longitudinal direction along the arms, and a pin 88 (replacing channel 70) formed on the side walls 18,20, and positioned in the slot 86. Whereby, the pivot axis of the lever 58 is not fixed with respect to the housing 16. The drive means comprises a pin 90 on each arm 60 of the lever 58 which fits in a bore or aperture 92 formed in the sliders 30,31 adjacent to the lower edge 50 of the sliders. With this arrangement, the lever 58 can only pivot relative to the sliders 30,31 whilst driving the sliders along the slide surfaces 28, whereas the lever can both pivot and have translational movement (along the longitudinal axis of the slots 86) relative to the housing 16 of the first part 12.

Figure 6:
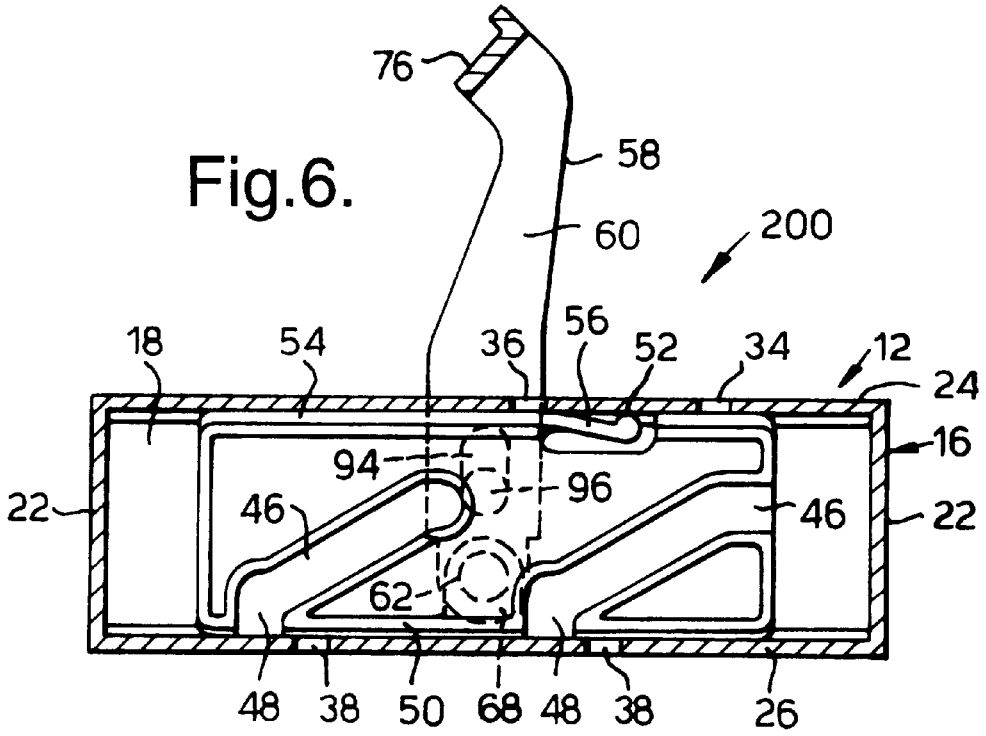
FIG. 6 is a cross-sectional view of one part of a third embodiment of electrical connector in accordance with the present invention with the lever in an intermediary position.

The third embodiment of electrical connector 200 shown in FIG. 6 is substantially the same as the first embodiment, and like parts have been given the same reference numeral. The third embodiment differs from the first embodiment in respect of the arrangement of the drive means between the lever 58 and the sliders 30,31. In the third embodiment, the drive means comprises a slot 94 (replacing pin 64) formed in each arm 60 of the lever 58, the slots extending in a longitudinal direction along the arms, and a pin 96 (replacing channel 70) formed on the sliders 30,31, which fits in the slot. As the lever 58 pivots relative to the housing 16 of the first part 12, the pins 96 move along the slots 94 to slide the sliders 30,31 relative to the side walls 18,20.

Figure 7:
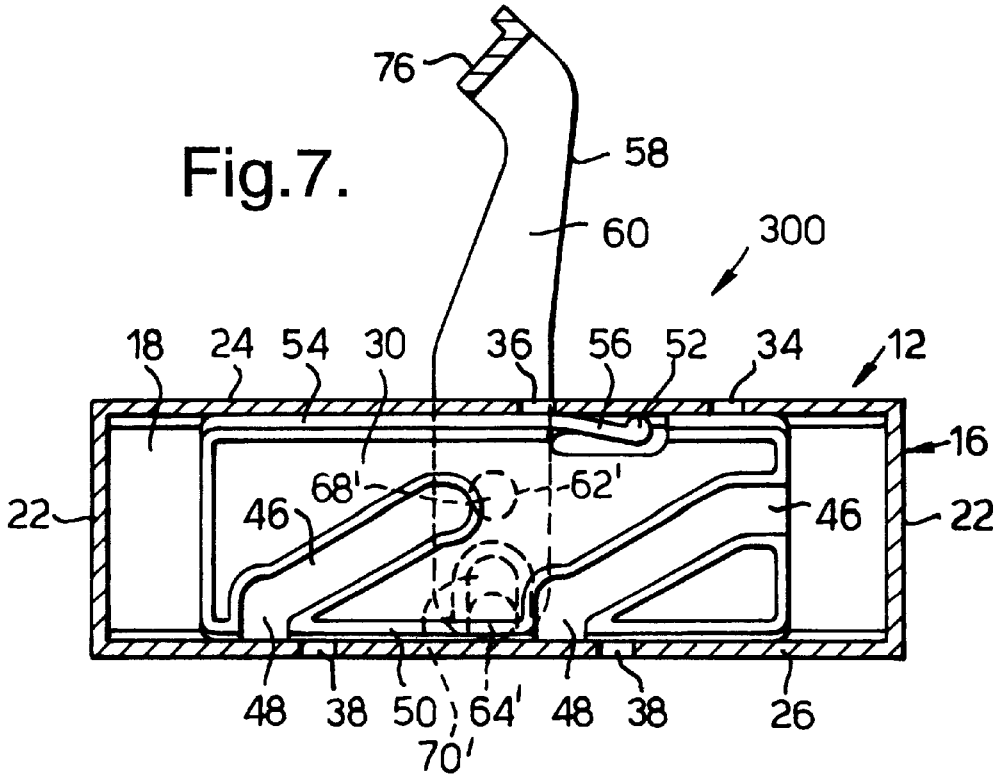
FIG. 7 is a cross-sectional view of one part of a fourth embodiment of electrical connector in accordance with the present invention with the lever in an intermediary position.

The fourth embodiment of electrical connector 300 shown in FIG. 7 is substantially the same as the first embodiment, and like parts have been given the same reference numeral. The fourth embodiment differs from the first embodiment in respect of the positioning of the pivot means and the drive means in that the positioning is reversed when compared to the first embodiment. In the fourth embodiment, the aperture 62' formed in each arm 60 of the lever 58 and the pin 68' formed on the side walls 18,20, are located nearer the base portion 76 of the lever 58 than the pin 64' on each arm, and the channel 70' in each slider 30,31 which receives the pin 68' opens through the lower edge 70 of the slider rather than the upper edge 54.

The slide surfaces 28 in the upper and lower walls 24,26, and the upper and lower edges 54,50 of the sliders 30,31 may have corresponding shoulders (not shown) to ensure correct installation of the sliders in the housing 16 of the first part 12. After installation of the sliders 30,31 through the slots 32 and into the housing 16 of the first part 12, the arms 60 of the lever 58 are pushed into the slots 66 in the upper walls 24 to make snap fits at the pivot means between the lever and the housing of the first part, and the drive means between the lever and the sliders.

The pivot means of the aperture 62 and the pin 68 may be reversed with the pin on the lever 58 and the aperture in the side wall 18,20.

What is claimed is:

1. An electrical connector comprising a first part mateable with a second part along a mating axis, the first part including a housing having opposed side walls and opposed end walls, each side wall having an upper wall and a lower wall defining opposed slide surfaces extending in a direction substantially perpendicular to the mating axis, first and second spaced apertures in the upper wall of each side wall, a pair of spaced apertures in the lower wall of each side wall, and a longitudinally extending slot in the upper wall of each side wall; a slider positioned adjacent each side wall, each slider having an upper edge and a lower edge making a sliding engagement with the slide surfaces of the upper wall and the lower wall, respectively, of the side walls, a pair of inclined cam surfaces having openings in the lower edge alignable with the apertures in the lower wall of the side walls, and a resilient tab in the upper edge for making a snap fit in the first aperture or the second aperture in the upper wall of the side wall; a substantially U-shaped lever having a pair of arms, each arm extending through the slot in the side wall to be positioned between the side wall and the adjacent slider; pivot means on each arm and each side wall to allow the lever to pivot relative to the housing of the first part; and drive means on each arm and each slider to slide each slider relative to the adjacent side wall on pivoting of the lever relative to the housing of the first part; the second part including a housing having side walls and end walls positionable inside the side wall and end walls of the housing of the first part, each side wall of the housing of the second part having a pair of spaced cam followers which can pass through the apertures in the lower walls and the openings in the inclined cam surfaces for sliding movement along the cam surfaces; pivoting movement of the lever moving the second part relative to the first part along the mating axis between a fully unmated position in which the tabs on each slider make a snap fit in the first aperture in the upper walls and a fully mated position in which the tabs make a snap fit in the second aperture in the upper walls.

2. An electrical connector as claimed in claim 1, wherein the cam surfaces in each slider are defined by open-sided inclined channels, and the cam followers on the housing of the second part are defined by pins formed on the side walls of the housing.

3. An electrical connector as claimed in claim 1 or claim 2, wherein the tab on the upper edge of each slider is formed on the end of a resilient arm or on a resiliently flexible beam.

4. An electrical connector as claimed in claim 1 or claim 2, wherein slots are formed in the housing of the first part between the end walls and the side walls for installation of the sliders into the housing.

5. An electrical connector as claimed in claim 1 or claim 3, wherein the first part further comprises a cover which makes a snap fit on the housing of the first part.

6. An electrical connector as claimed in claim 5, wherein the cover has a tab in its upper surface which makes a snap fit with the lever when the lever is pivoted to the fully mated position.

7. An electrical connector as claimed in claim 1, wherein the pivot means comprises an aperture formed in each arm of the lever which makes a snap fit with a pin formed internally on each side wall.

8. An electrical connector as claimed in claim 1 or claim 7, wherein the drive means comprises a pin formed on each arm of the lever which makes a sliding fit in an external open-sided channel formed in each slider, the channel extending substantially parallel with the mating axis.

9. An electrical connector as claimed in claim 1 or claim 7, wherein the drive means comprises a pin formed externally on each slider which makes a sliding fit in a longitudinally extending slot formed in each arm of the lever.

10. An electrical connector as claimed in claim 1, wherein the pivot means comprises a pin formed internally on each side wall which makes a sliding fit in a longitudinally extending slot formed in each arm of the lever, and wherein the drive means comprises a pin formed on each arm of the lever which makes a snap fit in an external aperture formed in each slider.

11. An electrical connector as claimed in claim 2 wherein the first part includes a cover that has a tab that makes a snap fit with the lever when the lever is pivoted to the fully mated position.

12. An electrical connector comprising:

a first part including;

a housing having;

opposed side walls and opposed end walls, each side wall having an upper wall and a lower wall extending inward from the housing, the upper wall and the lower wall defining opposed slide surfaces internal of the housing and longitudinally extending in a direction substantially perpendicular to a mating axis, a pair of spaced apertures in the lower wall of each side wall, and a longitudinally extending slot in the upper wall of each side wall, a slider positioned adjacent to each side wall and internal to the housing, each slider having, an upper edge and a lower edge making a sliding engagement with the slide surfaces of the upper wall and the lower wall, respectively, of the side walls, and a pair of inclined cam surfaces each having an opening in the lower edge alignable with the apertures in the lower wall of the side walls, an U-shaped lever having a pair of arms, each arm extending through the slot in the side wall to be positioned between the side wall and the adjacent slider, pivot means on each arm and each side wall whereby the lever pivots relative to the housing of the first part about an axis fixed with respect to housing, and drive means on each arm and each slider to slide each slider relative to the adjacent side wall on pivoting of the lever relative to the housing of the first part; and a second part having a pair of side walls, each side wall having a pair of spaced cam followers positioned to pass through the apertures in the lower walls, the side walls of the second part disposed between the sliders, each slider disposed between the side wall of the second part and the arm of the lever, each arm disposed between the slider and the side wall of the housing so that the pivot means and the drive means are internal to the housing, the second part mateable with the first part along the mating axis so that the cam followers and the internal cam surfaces are internal to the housing and internal to the sliders.

13. An electrical connector as claimed in claim 12, wherein the drive means comprises a pin formed on each arm of the lever which makes a sliding fit in an external open-sided channel formed in each slider, the channel extending substantially parallel with the mating axis.

14. An electrical connector as claimed in claim 13 wherein the slider further comprises a ramp perpendicular to the channel, the ramp for guiding the pin of the lever into the channel after the sliders are initially engaged into the upper and lower walls and after the lever arms are positioned through the upper wall slots and pivotally secured to the housing, the lever thereby holding the first side wall to the end walls of the housing, the pins sliding up the ramps and snapping into the channels thereby locking the sliders to the housing.

* * * * *